US006070022A

United States Patent [19]

Kobayashi et al.

[11] Patent Number: 6,070,022

[45] **Date of Patent: *May 30, 2000**

[54] IMAGE FORMING APPARATUS HAVING A SYSTEM FOR PERFORMING IMAGE DENSITY ADJUSTMENT BY DETECTING LIGHT REFLECTED OFF A PHOTOSENSITIVE MEMBER

[75] Inventors: Tatsuya Kobayashi, Soka; Yoichiro Maebashi, Numazu, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/900,291

[22] Filed: Jul. 25, 1997

[30] Foreign Application Priority Data

Jul. 26, 1996 [JP] Japan ..... 8-215189
Jul. 26, 1996 [JP] Japan ..... 8-215190

[51] Int. Cl.[7] ..... G03G 15/00

[52] U.S. Cl. ..... 399/12; 399/49; 399/72; 399/159

[58] Field of Search ..... 399/24, 25, 26, 399/38, 43, 46, 49, 72, 159, 12

[56] References Cited

U.S. PATENT DOCUMENTS 4,367,944 1/1983 Kuru ..... 399/46
5,701,402 12/1997 Miyamoto et al. ..... 395/115

FOREIGN PATENT DOCUMENTS 0604941 7/1994 European Pat. Off. .
0699978 3/1996 European Pat. Off. .
0703508 3/1996 European Pat. Off. .
3-230172 10/1991 Japan .
4-299375 10/1992 Japan .
5-40371 2/1993 Japan .
7-36230 2/1995 Japan .

*Primary Examiner*—Joan Pendegrass
*Attorney, Agent, or Firm*—Fitzpatrick, Cella, Harper & Scinto

[57] ABSTRACT

An image forming apparatus has a photosensitive member, an image forming means for forming an image on the photosensitive member, a density detecting means adapted to detect density of the image formed on the photosensitive member and a light emitting element and a light receiving element for receiving reflection light reflected from the photosensitive member, an image forming condition controlling means for controlling an image forming condition of the image forming means on the basis of detected density of a test image formed on the photosensitive member, a memory means for storing information regarding the photosensitive member, and a light emitting amount controlling means for controlling a light emitting amount of the light emitting element on the basis of the information regarding the photosensitive member.

19 Claims, 16 Drawing Sheets

IMAGE FORMING APPARATUS HAVING A SYSTEM FOR PERFORMING IMAGE DENSITY ADJUSTMENT BY DETECTING LIGHT REFLECTED OFF A PHOTOSENSITIVE MEMBER

BACKGROUND OF THE INVENTION

1. Field of the Invention

The present invention relates to an image forming apparatus such as a copying machine and a printer using an electrophotographic technique, and a process cartridge mountable to such an image forming apparatus, and more particularly, it relates to an image forming apparatus and a process cartridge, in which density of an image formed on a photosensitive member can automatically be adjusted.

2. Related Background Art

FIG. 3 is a sectional view of an image forming apparatus having an image density adjusting function. In this apparatus, a photosensitive drum (electrophotographic photosensitive member) 1, a charge roller (charge means) 2 and a cleaning means 7 are integrally provided as a process cartridge 100, which is constructed as shown and is detachably mounted to a frame 90 of the image forming apparatus via a mounting guide means 80.

While the photosensitive drum 1 is being rotated in a direction shown by the arrow by a drive means (not shown), a surface of the photosensitive drum is uniformly charged by the first charger 2 with predetermined potential. Then, laser light corresponding a magenta image pattern is illuminated on the photosensitive drum 1 through an exposure apparatus 3 to form an electrostatic latent image on the photosensitive drum 1.

As shown in FIG. 5, the photosensitive drum 1 is constituted by a conductive (such as aluminium) drum base 1*a* and a photosensitive layer 1*b* made of organic photo-conductor (OPC) and coated on the drum base, and the drum base 1*a* is grounded. The photosensitive layer 1*b* has four-layer structure including a conductive layer (CL) 1*b*-1, an injection preventing layer (IPL) 1*b*-2, a charge generating layer (CGL) 1*b*-3, and a charge transporting layer (CTL) 1*b*-4.

Four developing devices 4 (4*a*, 4*b*, 4*c* and 4*d*) are mounted on a support 5 at a downstream side of the process cartridge 100 in a rotational direction of the photosensitive drum 1. Each of the developing devices 4*a* to 4*d* is formed as a cartridge which can be detachably mounted on the support 5 (and, accordingly, on the body 90 of the image forming apparatus). When the photosensitive drum 1 is rotated in the direction shown by the arrow, the support 5 is rotated so that the developing device 4*a* including magenta (M) toner among four developing devices is opposed to the photosensitive drum 1. The latent image formed on the photosensitive drum 1 is developed by the developing device 4*a* so selected, to thereby visualize as a magenta toner image. The magenta toner image is transferred onto an intermediate transfer belt (intermediate toner member) 5. While the intermediate transfer belt 5 is being rotated in a direction shown by the arrow at substantially the same speed as the photosensitive drum 1, by applying primary (first) transfer bias to a first transfer roller 14 opposed to the photosensitive drum 1 with the interposition of the intermediate transfer belt 5, the magenta toner image formed on the photosensitive drum 1 is primary-charged on an outer peripheral surface of the intermediate transfer belt 5.

By repeating the above-mentioned processes successively regarding a cyan color (C), a yellow color (Y) and a black color (K), a color image is formed on the intermediate transfer belt 5 by superimposing the magenta, cyan, yellow and black toner images. A transfer material (such as a paper sheet) is picked up from a transfer material cassette 11 by a pick-up roller 12 at a predetermined timing, and the picked-up transfer material is supplied to the intermediate transfer belt 5, and, at the same time, by applying second transfer bias to a second transfer roller 8, the four color toner images on the intermediate transfer belt 5 are collectively transferred onto the transfer material. The transfer material to which the four color toner images were transferred is sent to a fixing device 6, where the toner images are fused and mixed by heat and pressure, to thereby form a full-color image. Residual toner remaining on the photosensitive drum 1 is cleaned by a conventional cleaning means 7 including a cleaning blade.

Within the body 90 of the image forming apparatus, a density sensor 9 is disposed in the vicinity of the photosensitive drum 1. In general, in color image forming apparatuses of electrophotographic type, when image density is changed in accordance with various conditions such as an environmental condition (temperature, humidity), the number of copy sheets and the like, the correct color of the color image itself could not be obtained. Thus, density detecting test images (patch images) are formed on the photosensitive drum 1 with various color toners, and density of each image is detected by the density sensor 9. On the basis of the detection results, image density control is effected through feed-back of detection results of the exposure amount and the developing bias, to thereby obtain a stable image.

As shown in FIG. 6, the density sensor 9 comprises a light emitting element 91 such as LED, a light receiving element 92 such as a photo-diode, and a holder 93. In this case, an infrared ray from the light emitting element 91 is illuminated on the patch image P on the photosensitive drum 1, and light reflected from the patch image is received by the light receiving element. By measuring an amount of the reflected light, density of the patch image is detected. The light reflected from the patch image includes specular reflection components and irregular reflection components. Since a light amount of the specular reflection components is greatly changed in accordance with a condition of the surface of the photosensitive member as a background for the patch image and/or a distance between the sensor 9 and the patch image P, if the specular reflection components are included in the light reflected from the patch image P, the detection accuracy will be greatly worsened. To avoid this, in the density sensor 9, an angle of illumination light incident to the patch image P is selected to 45° and an angle of the reflected light (reflected from the patch image P) received by the light receiving element is selected to 0° so that the specular reflection components from the patch image P do not enter into the light receiving element 92, to thereby measure the irregular reflection components alone.

Further, when the light emitting amount is decreased by degradation of the LED as the light emitting element 90 or if a measuring surface of the sensor is smudged by toner, it is difficult to maintain the initial ability of the density sensor 9 as it is. To cope with this, there has been proposed a method for correcting of the density sensor 9 by adjusting drive current of the light emitting element 91 so that an output (light receiving amount) of the light receiving element 92 shows a predetermined value (see Japanese Patent Application Laid-Open No. 7-36230.

However, this density sensor correcting method is based on the assumption that the colors on the photosensitive drum, i.e., reflection factors have no dispersion independently. In order to effect the correction of the density sensor 9, it is required that all of photosensitive drum are manufactured to have no dispersion in their reflection factors, to thereby increase the manufacturing cost of the photosensitive drum. Particularly, in the image forming apparatus of process cartridge type as shown in FIG. 3, since the cartridge must be exchanged, all of the photosensitive drums in the respective cartridge must have the same reflection factor.

Further, upon the so-called image density control in which, prior to normal image formation, density detecting image (patch images) are formed on a photosensitive drum to detect, and density of each image by density sensor comprised of a light emitting element and a light receiving element, and, on the basis of the deflection results, various image forming conditions such as charge potential of the photosensitive drum, a light amount of an exposure device and developing bias to be applied to a developing means are controlled, when a cartridge (process cartridge or developing cartridge) is exchanged, the image density is changed due to dispersion in sensitivities of the photosensitive drums and/or dispersion in frictional charging features of toners.

Although various efforts for stabilizing such variable factors have been made, satisfactory result has not yet been achieved. Thus, particularly, in the color image forming apparatuses, in order to obtain desired density and color balance, four color (Y, M, C and K) image forming conditions must be adjusted, and, hence, it is advantageous that the image density is automatically controlled by making the above control automatic. Further, the above control may be performed when the power source of the image forming apparatus is turned ON, when each cartridge is exchanged and when a predetermined number of copies are finished. In particular, when a temperature/humidity sensor for detecting temperature and humidity in the image forming apparatus is provided, such control may be performed only if predetermined change in temperature/humidity occurs.

However, in the above conventional image forming apparatus, since the image forming conditions must be controlled in consideration of all variable factors, a number of patch images having different image forming conditions must be formed, and, thus, the control time is increased accordingly and a large number of toner is consumed. To avoid that, it is considered that a smaller number of patch images are formed. In this case, however, control error is increased accordingly, which causes poor color balance particularly in the color image. Alternatively, upon manufacturing, only photosensitive drums and toners having no or less dispersion may be selected. In this case, however, yield is greatly worsened, to thereby make the photosensitive drum and toner expensive.

SUMMARY OF THE INVENTION

The present invention aims to eliminate the above-mentioned conventional drawbacks, and has an object is to provide an image forming apparatus in which image density control can be performed with high accuracy.

Another object of the present invention is to provide an image forming apparatus in which correction of a density sensor can easily be effected.

A further object of the present invention is to provide an image forming apparatus in which an image can be formed with proper density regardless of difference between photosensitive members.

A still further object of the present invention is to provide an image forming apparatus in which an image can be formed with proper density even when a photosensitive member is exchanged.

A further object of the present invention is to provide an image forming apparatus which comprises a photosensitive member, an image forming means for forming an image on the photosensitive member, a density detecting means adapted to detect density of the image formed on the photosensitive member and having a light emitting element and a light receiving element for receiving reflection light reflected from the photosensitive member, an image forming condition controlling means for controlling an image forming condition of the image forming means on the basis of detected density of a text image formed on the photosensitive member, a memory means for storing information regarding the photosensitive member, and a light emitting amount controlling means for controlling a light emitting amount of the light emitting element on the basis of the information regarding the photosensitive member.

A still further object of the present invention is to provide a process cartridge mountable to an image forming apparatus, the process cartridge comprises a photosensitive member and a memory means for storing information regarding the photosensitive member.

A further object of the present invention is to provide an image forming apparatus which comprises a photosensitive member, an image forming means for forming an image on the photosensitive member, a density detecting means for detecting density of the image formed on the photosensitive member, a control means for controlling an image forming condition of the image forming means on the basis of detected density of a text image formed on the photosensitive member, and a memory means for storing information regarding the photosensitive member. Wherein the image forming means forms the text image on the photosensitive member on the basis of the information regarding the photosensitive member.

The other objects and features of the present invention will be apparent from the following detailed explanation referring to the accompanying drawings.

DETAILED DESCRIPTION OF THE PREFERRED EMBODIMENTS

The present invention will now be explained in connection with embodiments thereof with reference to the accompanying drawings.

Figure 1:
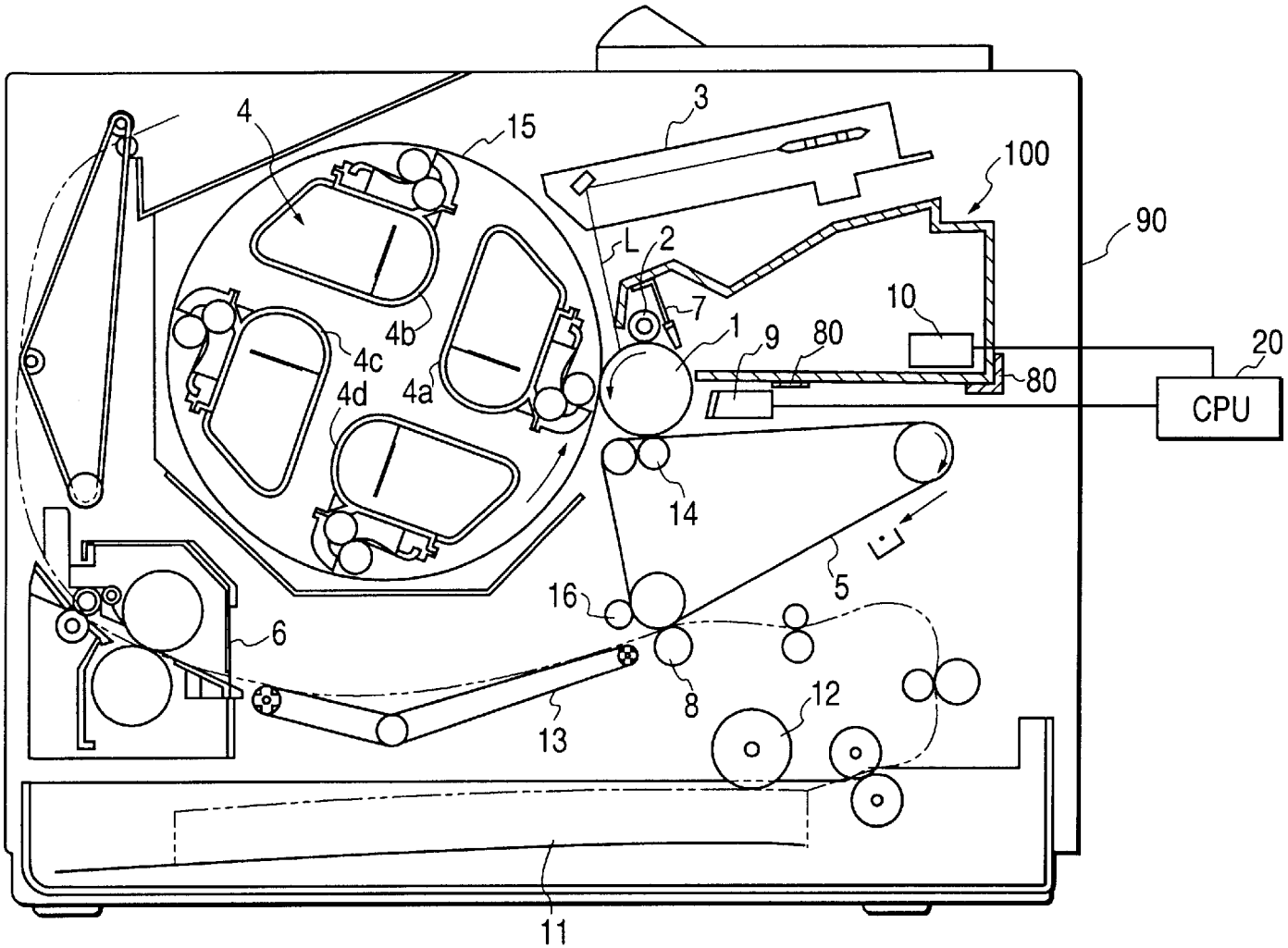
FIG. 1 is a sectional view of an image forming apparatus on which a process cartridge can be detachably mounted, according to an embodiment of the present invention.
Figure 3:
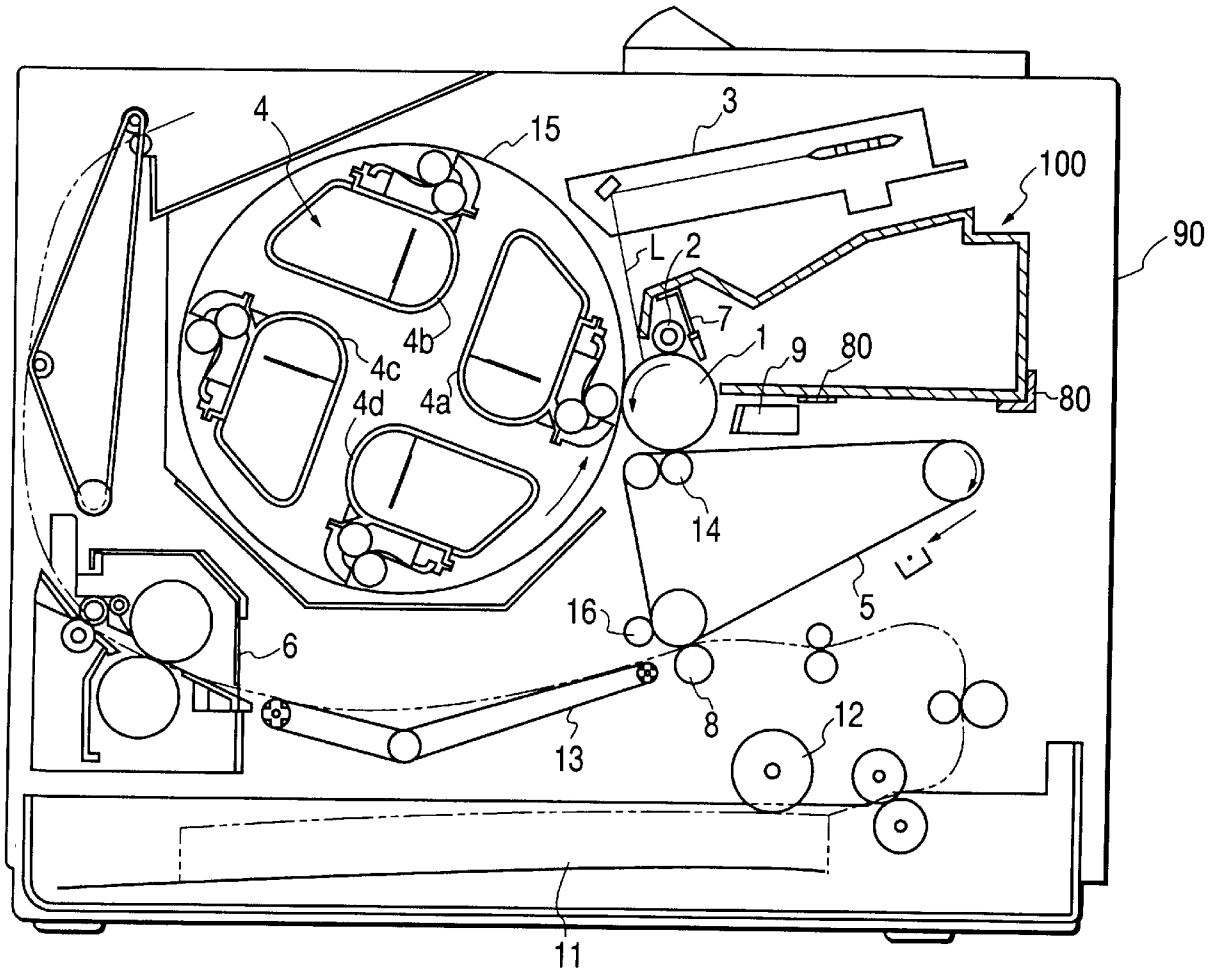
FIG. 3 is a sectional view of a conventional forming apparatus on which a process cartridge can be detachably mounted.
Figure 4:
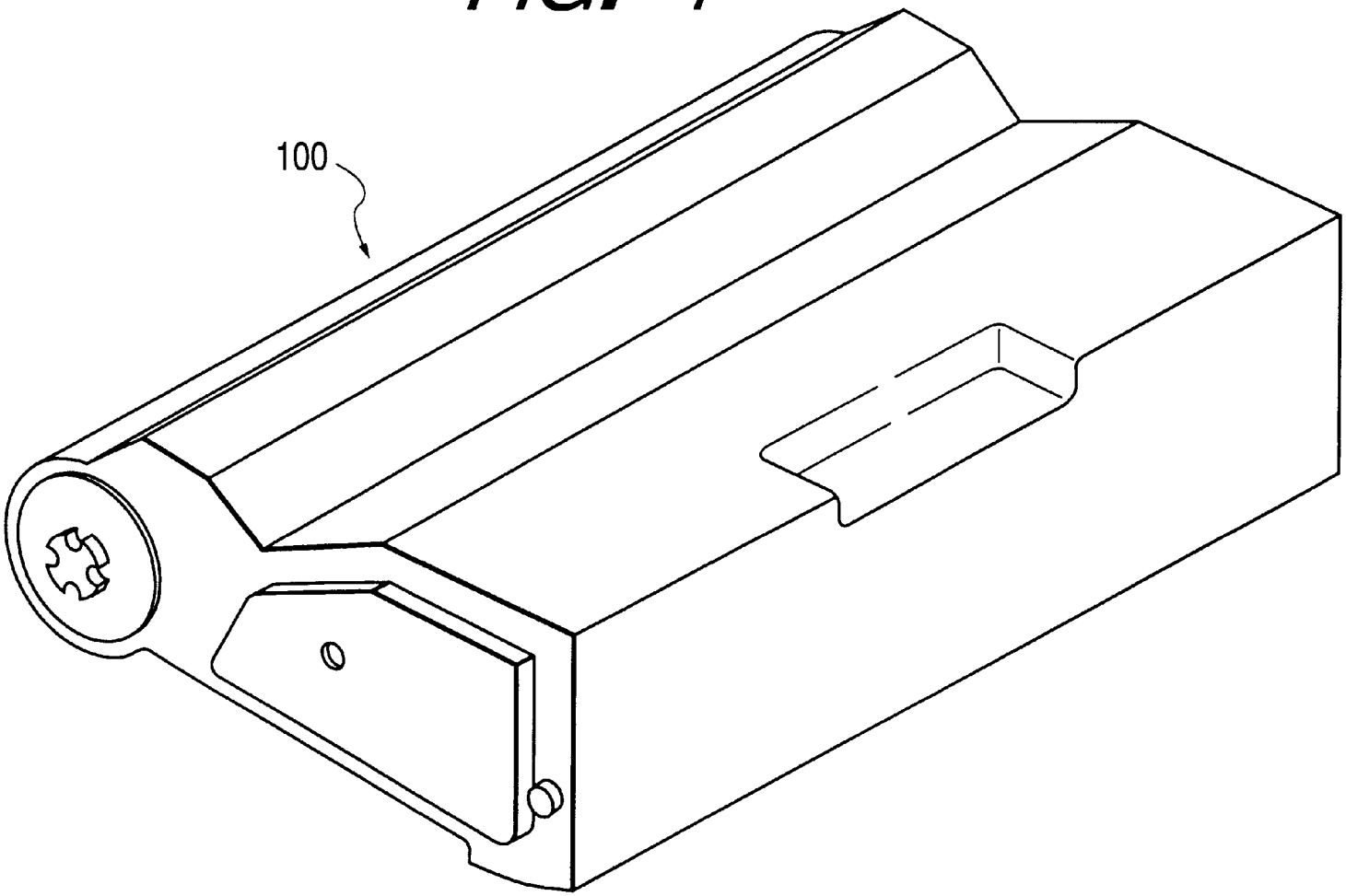
FIG. 4 is a perspective view of the process cartridge of FIG. 3.
Figure 5:
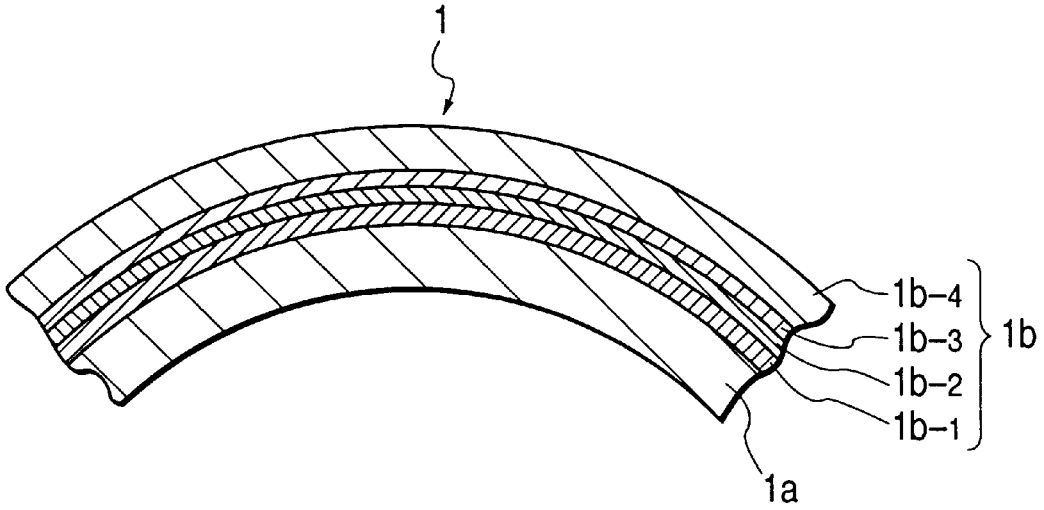
FIG. 5 is a sectional view showing a layer structure of a photosensitive layer of a photosensitive member disposed in the process cartridge of FIG. 3.

FIG. 1 is a sectional view showing an embodiment of an image forming apparatus (laser beam printer) according to the present invention. Elements having the same construction and function as those of the conventional image forming apparatus shown in FIG. 3 are designated by the same reference numerals and explanation thereof will be omitted.

A photosensitive drum (electrophotographic photosensitive member) 1, a first charger (charge means) 2 and a cleaning means 7 are integrally provided as a process cartridge 100 according to the present invention, which is detachably mounted to a body 90 of an image forming apparatus via a mounting guide means 80. The photosensitive drum 1 is rotatably supported in the process cartridge 100 and is disposed substantially at a central portion of the apparatus body 90, and the charger 2 and the cleaning means 7 are disposed around the photosensitive drum 1. Outside of the process cartridge 100, around the photosensitive drum 1, there are disposed an exposure device 3, four developing devices 4 (4*a*, 4*b*, 4*c* and 4*d*) mounted on a support 15, an intermediate transfer belt 5 and a density sensor 9. A fixing device 6 is disposed at a left and lower portion of the apparatus body 90.

A non-volatile memory means 10 having characteristic of the present invention is disposed within the process cartridge 100. The memory means 10 may be an electric memory means such as a RAM and a re-writable ROM, or a magnetic memory medium, or a magnetic bubble memory, or a magnetic memory means such as a photo-magnetic memory, or a mechanical memory means such as detection frames. However, other memory means can be used so long as it can store and hold information. In the illustrated embodiment, NVRAM (non-volatile RAM) is used in consideration of easy handling and low cost.

The memory means 10 stores information regarding density (infrared ray reflection factor) of the photosensitive drum 1 at the manufacture of the photosensitive drum (i.e., a light receiving amount of light reflected from the photosensitive drum when a predetermined amount of light is illuminated on the non-used photosensitive drum), and such information can be read by a CPU 20 of the apparatus body 90. In the illustrated embodiment, density VPH of background of the photosensitive drum 1 at the manufacture thereof is measured by a reference density sensor reference-calibrated at the manufacture of the photosensitive drum in the same condition as that when it is mounted on the image forming apparatus, and the measured result is stored in the memory means.

Figure 6:
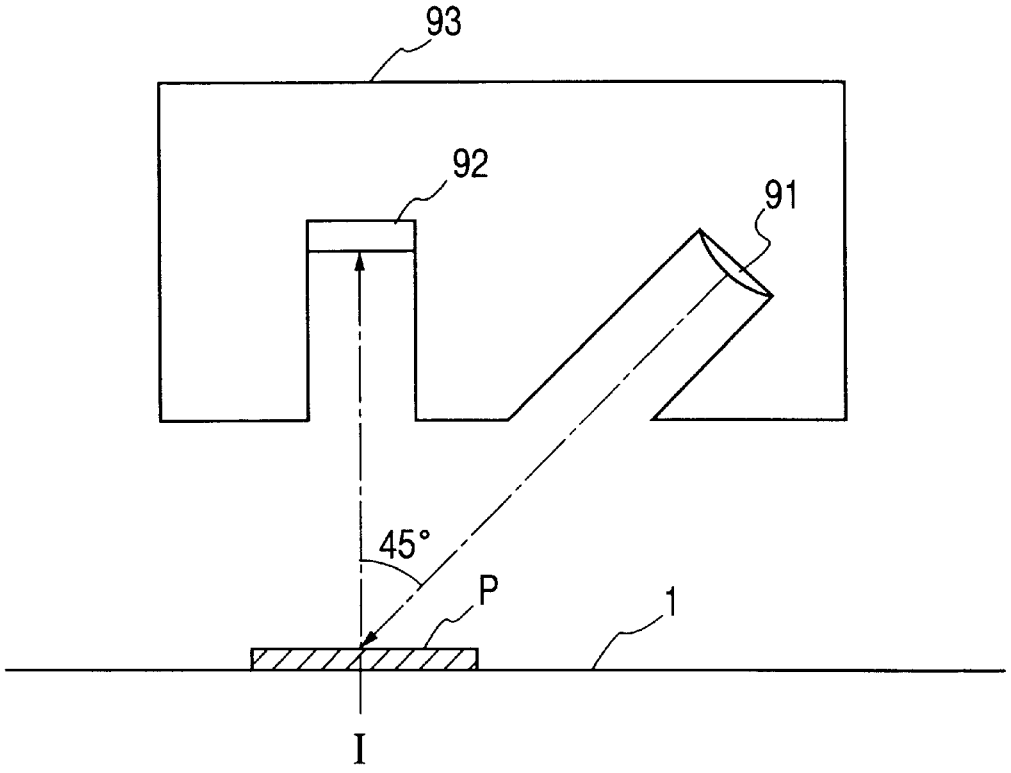
FIG. 6 is a schematic view of a density sensor disposed in the apparatus of FIG. 3.

In the density sensor 9 used in the illustrated embodiment, the illuminating light amount can be changed at 256 steps from 00h to FFh (h is hexadecimal number) on the basis of an 8-bit signal by command from the CPU 20. The illuminating light amount 00h means a minimum light amount (=0) and the illuminating light amount FFh means a maximum light amount. A mechanical structure of the density sensor 9 itself is the same as that shown in FIG. 6, and, thus, comprises a light emitting element 91 such as an LED, a light receiving element 92 such as a photo-diode, and a holder 93.

Figure 2:
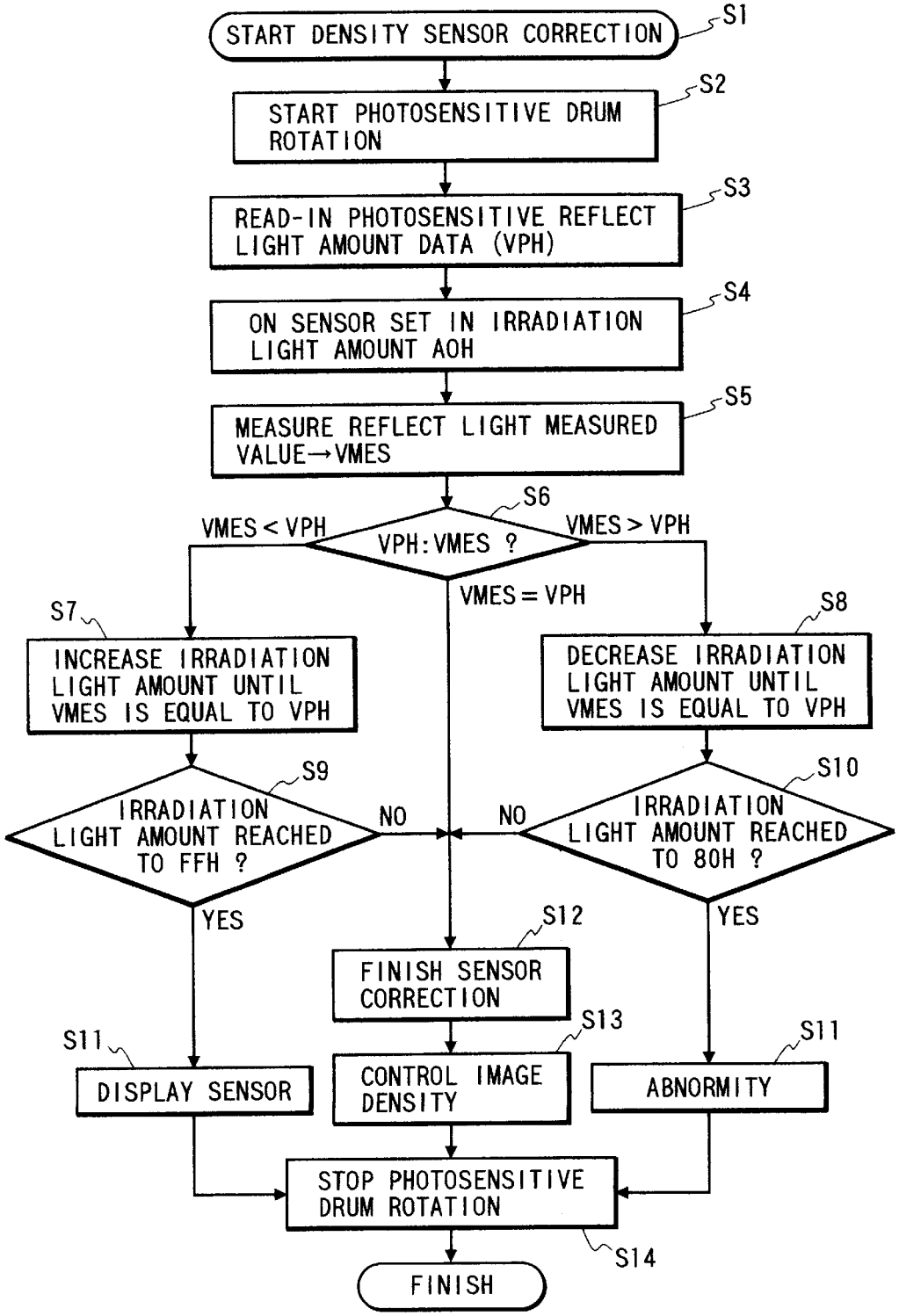
FIG. 2 is a flow chart showing a correcting method for a density sensor disposed in the apparatus of FIG. 1.

A correcting method for the density sensor 9 according to the present invention will be explained with reference to a flow chart shown in FIG. 2.

When the correction command for the density sensor 9 is inputted to the CPU 20 of the apparatus body 90, the density sensor correcting sequence is started (step S1). Then, the photosensitive drum 1 is rotated (step S2). The correction of the density sensor according to the illustrated embodiment is effected before image density control is performed. However, the correction may be effected by proper times in consideration of a time elapsed from the previous correction of the density sensor, the number of copies and/or change in environment.

Then, the CPU 20 reads out reflected light amount data VPH (step S3). Then, the light emitting element 91 of the density sensor 9 emits irradiation light amount AOH corresponding to a correction initial light amount, and a density VMES of the photosensitive drum 1 is measured on the basis of the received light amount of the light receiving element 92 (steps S4 and S5). Then, the CPU 20 compares VMES with VPH (step S6).

If VMES=VPH, the light amount A0h is selected to the irradiation light amount of the light emitting element 91 in the image density control. On the other hand, if the sensor output VMES is smaller than VPH, the irradiation light amount is increased by 1h by 1h until VMES reaches VPH (step S7). The light amount when VMES reaches VPH is selected to the irradiation light amount of the light emitting element 91 in the image density control.

If the irradiation light amount when VMES=VPH does not fall within a range between 80h and FFh, the correction of the density sensor is stopped, and further image density control is not effected. Further, sensor abnormality is displayed on a display panel (step S11), to thereby permit the operator to clean or change the density sensor.

After the correction of the sensor is finished correctly (step S12), the image density control is started (step S13). Lastly, the rotation of the photosensitive drum is stopped (step S14), to thereby finish the image density control.

As mentioned above, in the present invention, since the non-volatile memory means 10 is provided in the image forming apparatus and the reflected light amount data of the photosensitive drum 1 at the time of manufacture thereof (i.e., non-used photosensitive drum) is stored in the memory means and the optical density sensor 9 for measuring the density of the test image formed on the photosensitive drum 1 for the image forming condition control is corrected in accordance with the reflected light amount data of the photosensitive drum 1, reduction in correction accuracy of the density sensor due to dispersion of reflection factor of the photosensitive drum can be suppressed. Accordingly, the density of the test image can be detected with high accuracy. The accuracy of the image forming condition control is also improved. The adjustment of the reflect light amount (background density) of the photosensitive drum can be omitted, to thereby provide a cheaper photosensitive drum.

Next, an embodiment in which a test image is formed on a photosensitive drum and an image forming condition is controlled in accordance with density of the test image will be explained.

Figure 7:
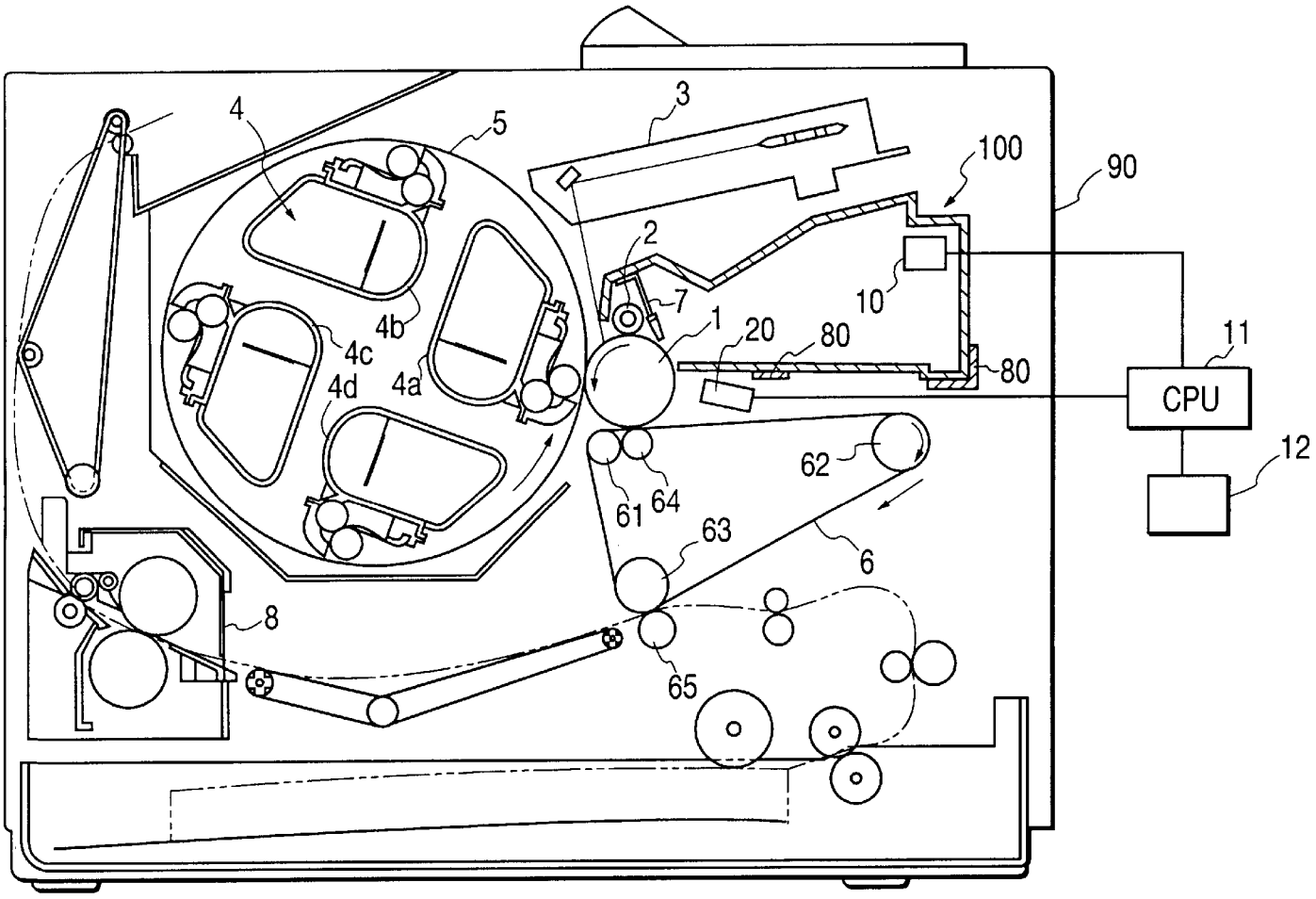
FIG. 7 is a sectional view of an image forming apparatus on which a process cartridge can be detachably mounted, according to an embodiment of the present invention.

FIG. 7 is a sectional view of an image forming apparatus in this embodiment. In this embodiment, a laser beam printer is shown as the image forming apparatus. Elements having the same construction and function as those of the conventional image forming apparatus shown in FIG. 3 are designated by the same reference numerals and explanation thereof will be omitted.

A photosensitive drum (electrophotograhic photosensitive member) 1, a charge roller (charge means) 2 and a cleaning means 7 are integrally provided as a process cartridge (photosensitive drum cartridge) 100 according to the present invention, which is detachably mounted to a body 90 of an image forming apparatus via a mounting guide means 80.

The characteristic of this embodiment is that a non-volatile memory means 10 is provided in the process cartridge 100 and sensitivity of the photosensitive drum 1 is judged on the basis of information stored in the memory means 10 so that an image forming condition used in image forming condition control can be changed.

Figure 8:
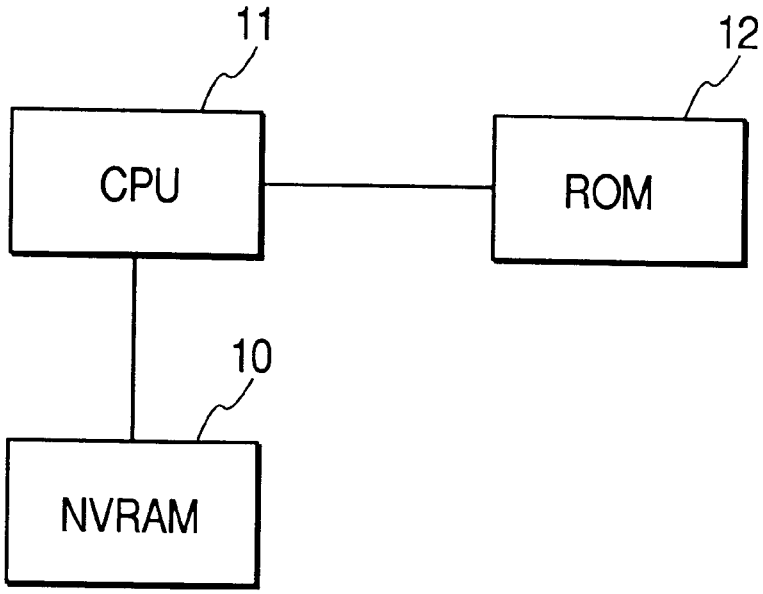
FIG. 8 is a block diagram showing a connection relation between a CPU, a ROM and an NVRAM.

The non-volatile memory means 10 used in this embodiment may be an electric memory means such as a RAM and a re-writable ROM, or a magnetic memory medium, or a magnetic bubble memory, or a magnetic memory means such as a photo-magnetic memory, or a mechanical memory means such as detection frames. However, other memory means can be used so long as it can store and hold information. In the illustrated embodiment, NVRAM (non-volatile RAM) is used in consideration of easy handling and low cost. A CPU 11 is provided in the body 90 of the image forming apparatus, and, as shown in FIG. 8, a ROM 12 and the NVRAM 10 are connected to the CPU 11. The CPU 11 reads the information stored in the NVRAM 10 of the photosensitive drum cartridge 100, and the read information is treated in accordance with the information in the ROM 12.

Figure 9:
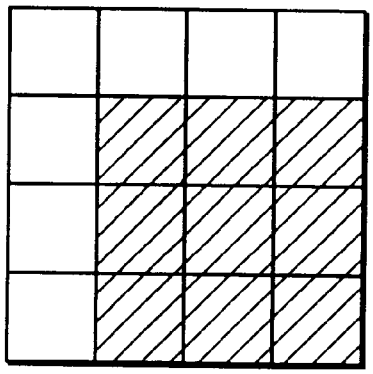
FIG. 9 is a view showing change in density of detecting image with respect to developing bias in case of uppermost sensitivity of a photosensitive drum.

In the illustrated embodiment, the exposure light amount is set so that the first charge potential of the photosensitive drum 1 becomes −600 V and exposure portion potential (when a photosensitive drum having average sensitivity is used) becomes −200 V. Further, as shown in FIG. 9, a detecting image is formed by using 3×3 print pattern among 4×4 dot matrix. The detecting image is formed by changing developing bias (among image forming conditions), and developing bias making optical density of the detection image to 1.0 is sought. The developing bias control is effected in this way.

Figure 10:
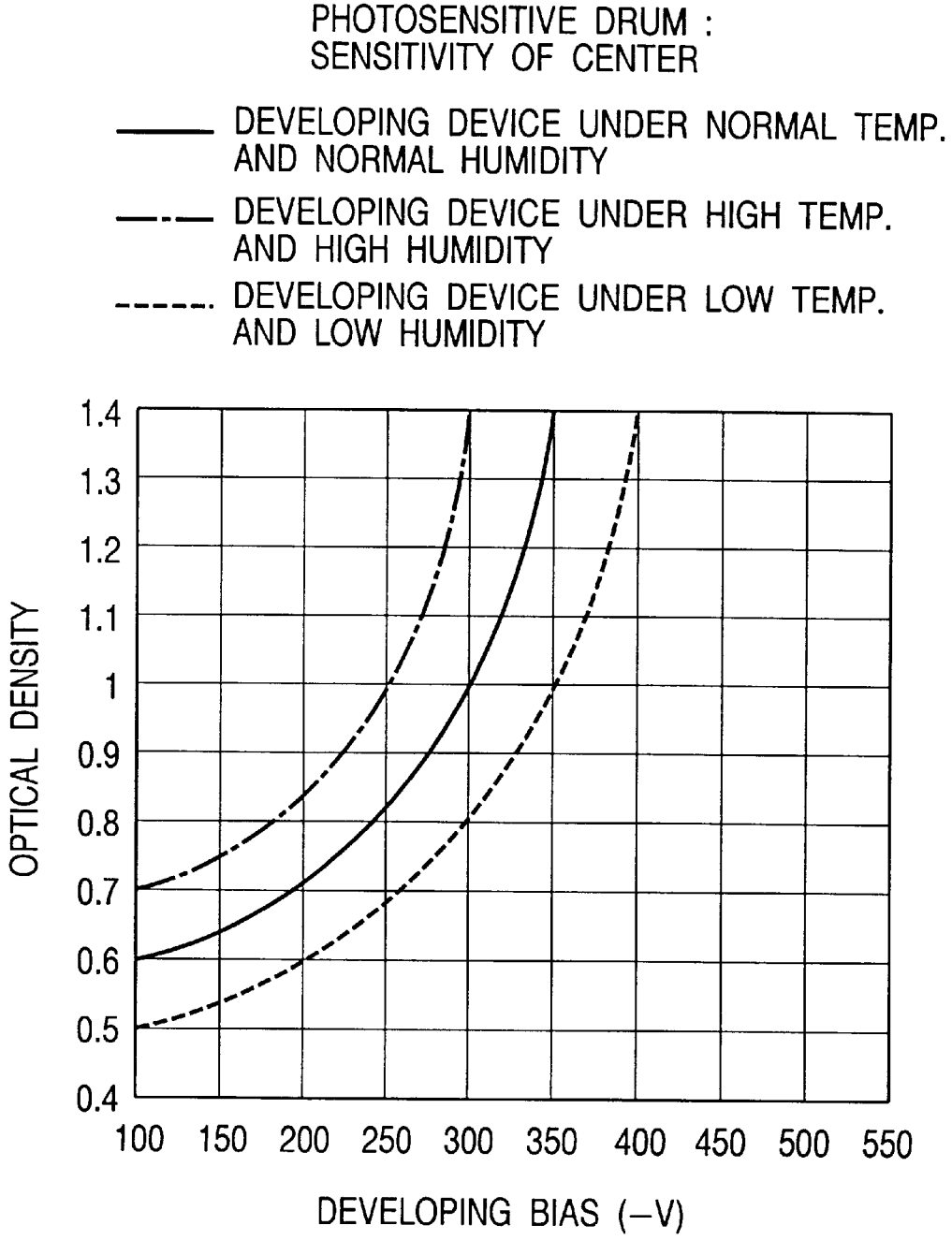
FIG. 10 is a graph showing change in density of detecting image with respect to developing bias in case of sensitivity of center of a photosensitive drum.
Figure 11:
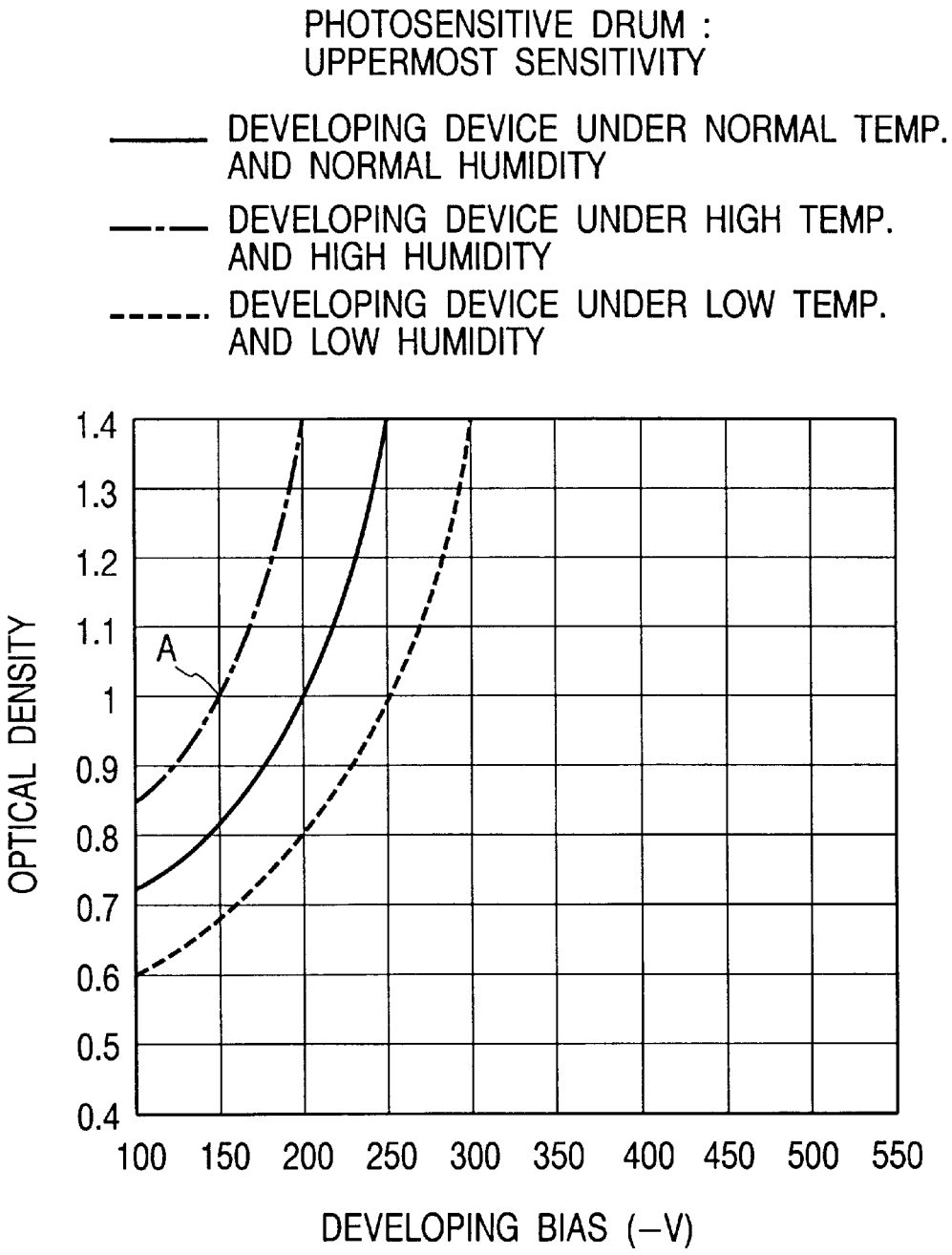
FIG. 11 is a graph showing change in density of detecting image with respect to developing bias in case of uppermost sensitivity of a photosensitive drum.
Figure 12:
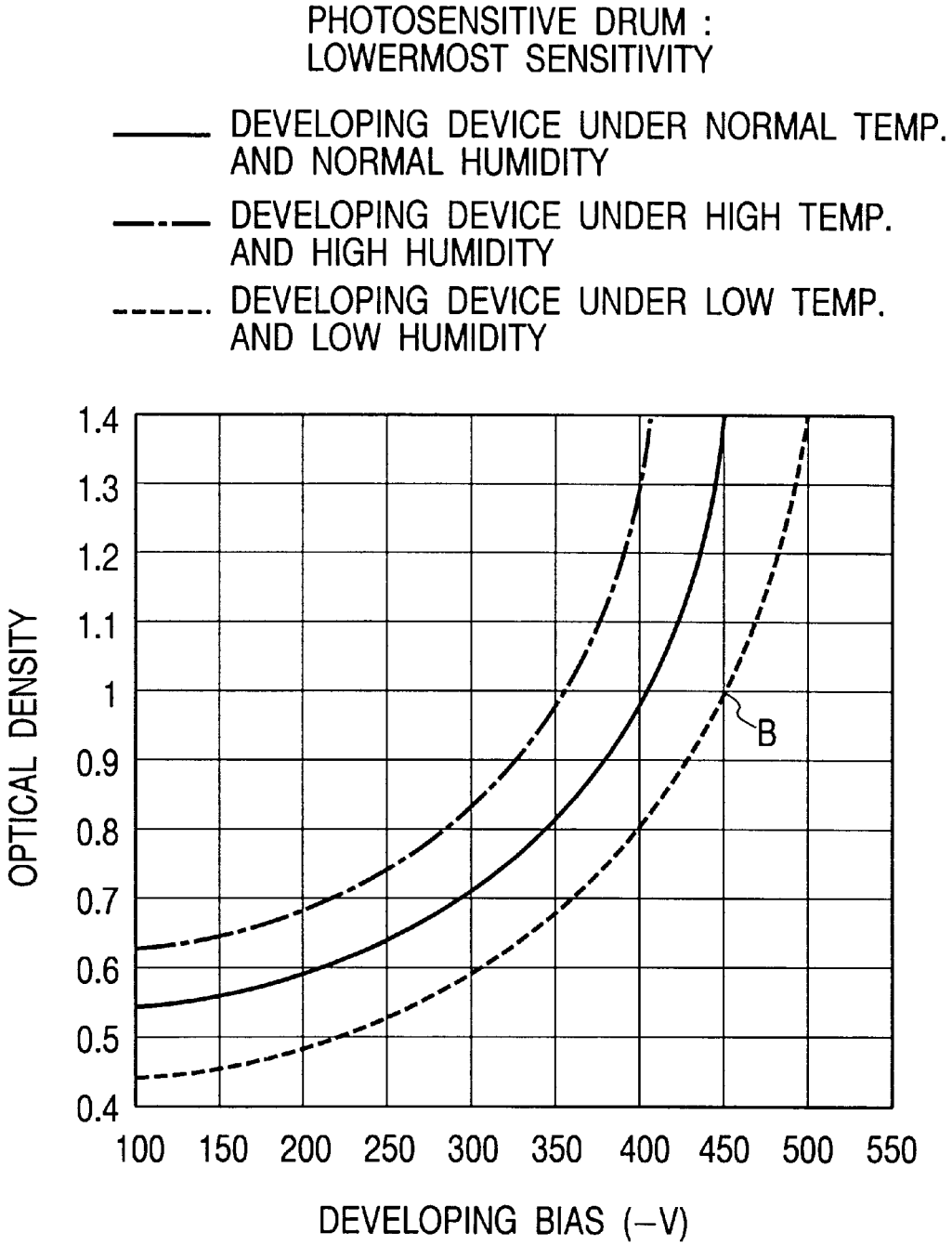
FIG. 12 is a graph showing change in density of detecting image with respect to developing bias in case of lowermost sensitivity of a photosensitive drum.

FIGS. 10 to 12 are graphs showing a relation between optical density of the detecting image and the developing bias. FIG. 10 shows the change in density of the detecting image under three environmental conditions (i.e., normal temperature and normal humidity condition (23° C., 60% Rh) and high temperature and high humidity condition (30° C., 80% Rh) and low temperature and low humidity condition (15° C., 10% Rh) when a photosensitive drum having average sensitivity and the exposure portion potential (regarding the light set as above mentioned) of −200 V is used, FIG. 11 shows the change in density of the detecting image under the above three environmental conditions when a photosensitive drum having excellent sensitivity to the exposure light and the exposure portion potential (regarding the light set as above mentioned) of −100 V is used, and FIG. 12 shows the change in density of the detecting image under the above three environmental conditions when a photosensitive drum having poor sensitivity to the exposure light and the exposure portion potential (regarding the light set as above mentioned) of −300 V is used.

As can be seen from FIGS. 10 to 12, the density feature is varied with the sensitivity of the photosensitive drum and the developing device associated with the photosensitive drum. In the conventional techniques, in order to seek developing bias satisfying the desired density 1.0, under the image forming condition control, the detecting images are formed while changing from the developing bias (=−150 V) shown by the arrow A in FIG. 11 when the density is greatest in the same developing bias (i.e., when the photosensitive drum shown in FIG. 11 is used and the developing device is used under the high temperature and high humidity) to the developing bias (=−450 V) shown by the arrow B in FIG. 12 when the density is smallest in the same developing bias (i.e., when the photosensitive drum shown in FIG. 12 is used and the developing device is used under the low temperature and low humidity), and the densities of the image are measured, thereby finishing the seeking developing bias.

To the contrary, in the present invention, the sensitivity information of the information of the photosensitive drum at the manufacture thereof is written in the NVRAM 10, and sensitivity information is read by the CPU 11 of the body 90 of the image forming apparatus, and the developing bias condition used in the image forming condition control is changed. That is to say, since the developing bias condition is controlled by the known sensitivity of the photosensitive drum 1, the control error for the developing bias becomes small, and the control time and consumed toner can be reduced.

Figure 13:
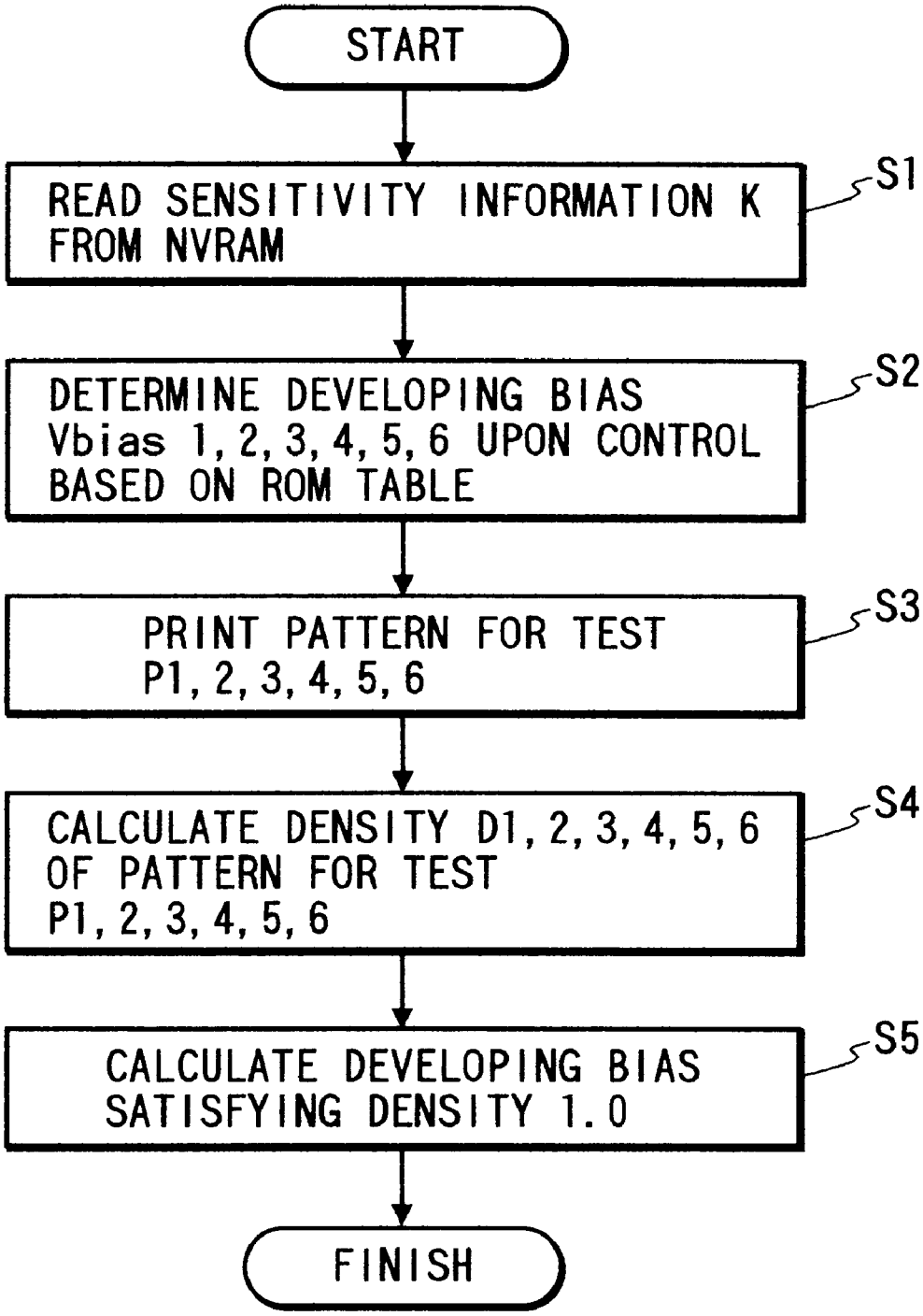
FIG. 13 is a control flow chart showing an image forming condition.

Detailed explanation will be made with reference to a control flow chart shown in FIG. 13.

In a step S1, the sensitivity information K of the photosensitive drum 1 stored in the NVRAM 10 of the process cartridge 100 mounted on the body 90 of the image forming apparatus is read by the CPU 11. In the illustrated embodiment, the sensitivity information K of the photosensitive drum is divided into ten groups 0, 1, 2, . . . , 9, and these groups are stored in predetermined addresses of the NVRAM one by one. The sensitivity information K=0 indicates sensitivity in which the exposed portion potential becomes −100 V to −119 V when the predetermined charging and the predetermined exposure are effected. Similarly, K=1 indicates −120 V to −139 V, K=2 indicates −140 V to −159 V, K=3, indicates −160 V to −179 V, K=4 indicates −180 V to −199 V, K=5 indicates −200 V to −219 V, K=6 indicates −220 V to −239 V, K=7 indicates −240 V to −259 V, K=8 indicates −260 V to −279 V and K=9 indicates −280 V to −300 V.

Then, in a step S2, the CPU 11 refers to developing bias Vbias corresponding to the sensitivity K of the photosensitive drum stored in the ROM 12 and determines the developing bias Vbias upon the test image forming image density control.

Figure 14:
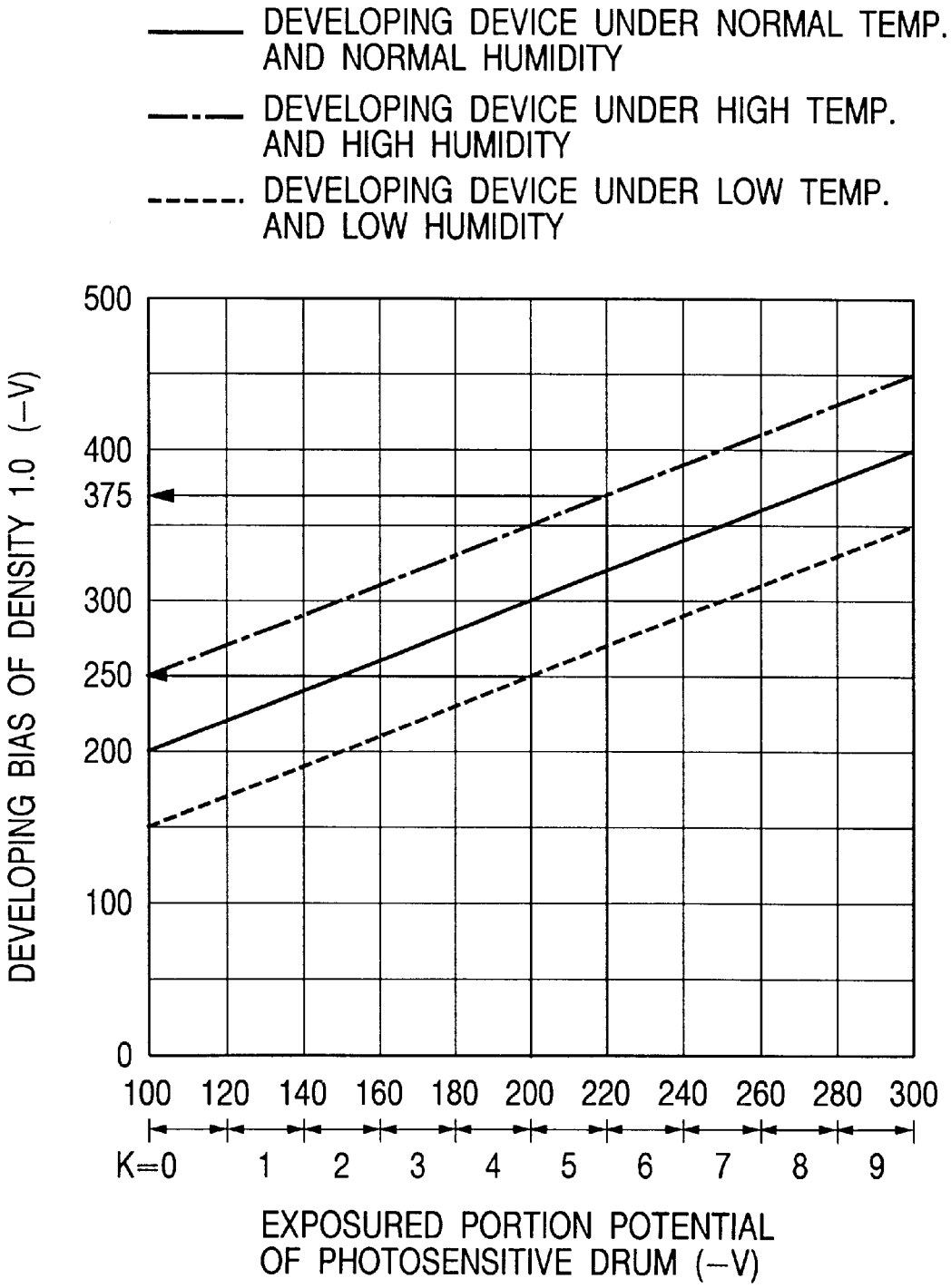
FIG. 14 is a graph showing a relation between exposed portion potential of the photosensitive drum and proper developing bias.

More specifically, FIG. 14 is a graph showing a relation between the developing bias in which the density of the detecting image (test image) satisfies 1.0 and the exposed portion potential of the photosensitive drum, the abscissa representing the exposed portion potential also indicates the range of the sensitivity K. For example, when K=5, as shown in FIG. 14, the developing bias upon the image density control is −250 V to −350 V, and −250 V, −275 V, −300 V, −325 V, −350 V and −375 V obtained by dividing the above range into six at 24 V interval may be used as the developing biases 1, 2, 3, 4, 5, 6 upon the image density control.

In a step S3, the detecting patterns (detecting images) P1, P2, P3, P4, P5 and P6 are formed (printed) by using the developing bias 1, 2, 3, 4, 5 and 6 determined in the step S2. Then, in a step S4, the densities of the printed detecting patterns P1, P2, P3, P4, P5 and P6 are measured by the density sensor 20, thereby determining the densities D1, D2, D3, D4, D5 and D6. Thereafter, in a step S5, the developing bias satisfying the density 1.0 is determined on the basis of the densities D1 to D6.

As mentioned above, the NVRAM (non-volatile memory means) 10 is mounted on the process cartridge 100, the sensitivity of the photosensitive drum 1 is stored in the NVRAM, the sensitivity of the photosensitive drum is referred to upon the image forming condition control, and the developing bias condition used in the image forming condition control is controlled on the basis of the sensitivity information. Thus, the error of the image forming condition control upon the exchange of the process cartridge becomes small, an image having stable density can be obtained, and the control time and consumed toner can be reduced. If the control becomes impossible (contamination or damage of the density sensor 20), by determining the developing bias used in the actual image formation on the basis of the sensitivity information of the photosensitive drum stored in the NVRAM of the process cartridge, even when the control is impossible, the change in density can be reduced.

Figure 15:
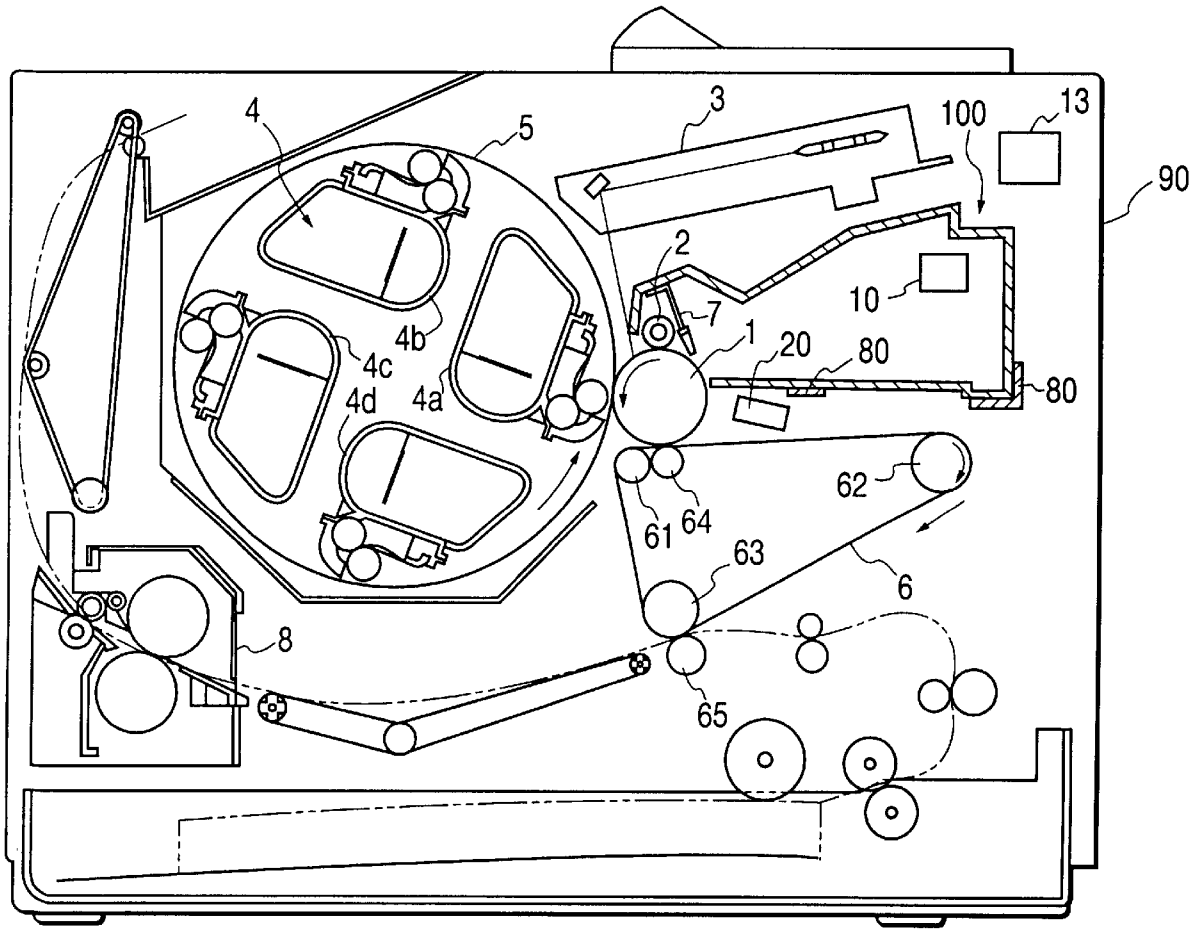
FIG. 15 is a sectional view of an image forming apparatus on which a process cartridge can be detachably mounted, according to another embodiment of the present invention.

FIG. 15 is a sectional view showing another embodiment.

Although the change in sensitivity of the photosensitive drum 1 sometimes occurs at the manufacture thereof as mentioned above, it is well known that the sensitivity of the photosensitive drum is changed the number of image formed sheets (prints). The reasons are considered that the sensitivity feature of the photosensitive layer of the photosensitive drum 1 is deteriorated by repeating the charging and the exposure and that the thickness of the photosensitive layer is decreased by the cleaning means to change the electrostatic capacity. Various efforts for stabilizing the feature regardless of the number of the prints have still been made, as well as the sensitivity stability at the manufacture of the photosensitive drum. However, the satisfactory results can not yet be achieved.

Figure 16:
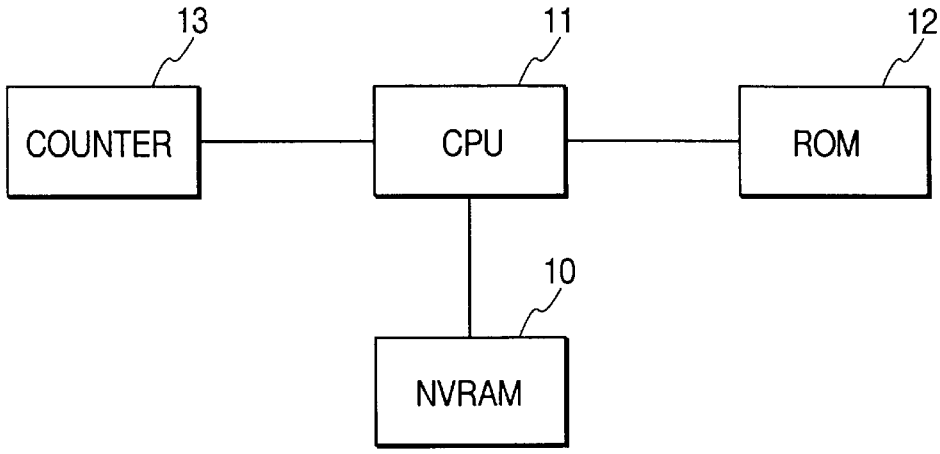
FIG. 16 is a block diagram showing a connection relation between a CPU, a ROM, an NVRAM and a counter.

In this embodiment, a counter 13 for counting the number of prints (image formed sheets) is provided within the body 90 of the image forming apparatus. The number of prints counted by the counter 13 is stored (written) in the NVRAM (non-volatile memory means) 10 provided in the process cartridge 100 by the CPU 11, and, upon the image forming condition control using the sensitivity information of the photosensitive drum 1 as is in the aforementioned embodiment, the image forming condition is corrected on the basis of the number of prints to obtain the optimum result. FIG. 16 shows a connection relation between the NVRAM 10, CPU 11, ROM 12 and counter 13.

Explaining the number of prints, the number of prints counted by the counter 13 is written in the NVRAM 10 of the process cartridge 100. It is not preferable that the writing of the print number is effected every point in consideration of the service life of the NVRAM 10 due to the limited writable number. Further, since the change in sensitivity of the photosensitive drum 1 normally occurs every several hundred prints, the writing may be effected every 100 to 1000 prints. However, if the power source of the apparatus body 90 is turned OFF before writing, since the accumulated number of prints is cleared, immediately before the power source is turned OFF, it is preferable that the number of prints is written in the NVRAM 10 even if not reach the predetermined number. Since the number to be written in the NVRAM 10 should be accumulated, the print number obtained by adding the number of prints to be written in the NVRAM to the number of prints already stored in the NVRAM may be written in the NVRAM.

Figure 17:
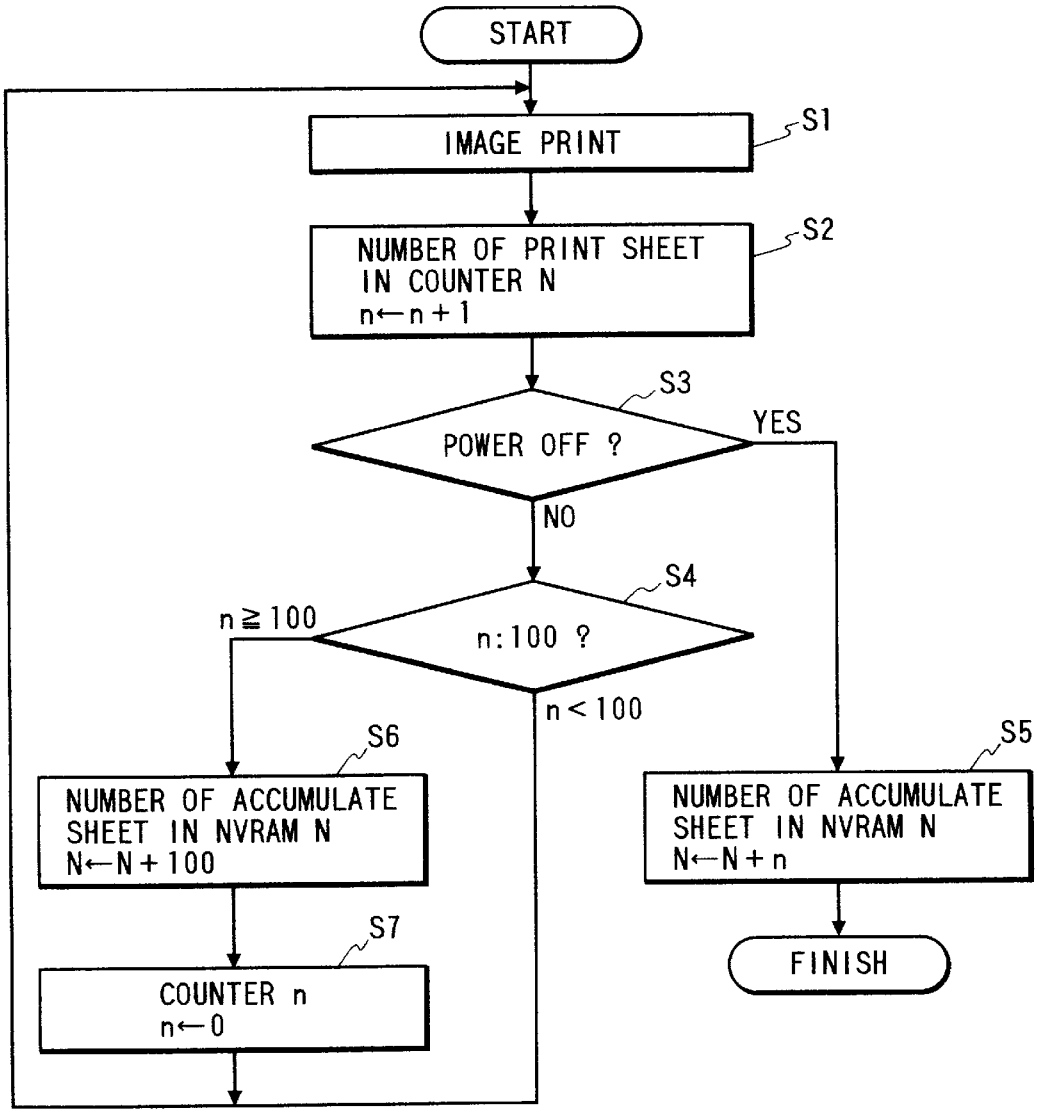
FIG. 17 is a flow chart regarding writing of number of accumulated print sheets in the apparatus of FIG. 15.

The writing in the NVRAM every 100 prints will be explained with reference to a flow chart shown in FIG. 17.

After the image is formed (printed) in a step S1, in a step S2, the print number n in the counter 13 is increased by one (1). Then, in a step S3, the CPU 11 judges whether the power source of the image forming apparatus is ON or OFF. If ON, the program goes to a step S4; whereas, if OFF, the program goes to a step S5.

In the step S4, it is judged whether the print number n is smaller than 100 or not. In the step S5, the number (N+n) obtained by adding the accumulated print number N in the NVRAM 10 to the counted print number n is written in the NVRAM 10, and then, the program is ended. On the other hand, in the step S4, if it is judged as $n \geqq 100$, in a step S6, the number (N+100) obtained by adding 100 to the accumulated print number N in the NVRAM 10 is written in the NVRAM 10. Then, in a step S7, the print number n of the counter is cleared to zero (0), and the program is returned to the step S1. In the step S4, if it is judged as $n<100$, the program is returned to the step S1.

Now, the control using the accumulated print number N in the NVRAM 10 will be explained with reference to a control flow chart shown in FIG. 18.

Figure 19:
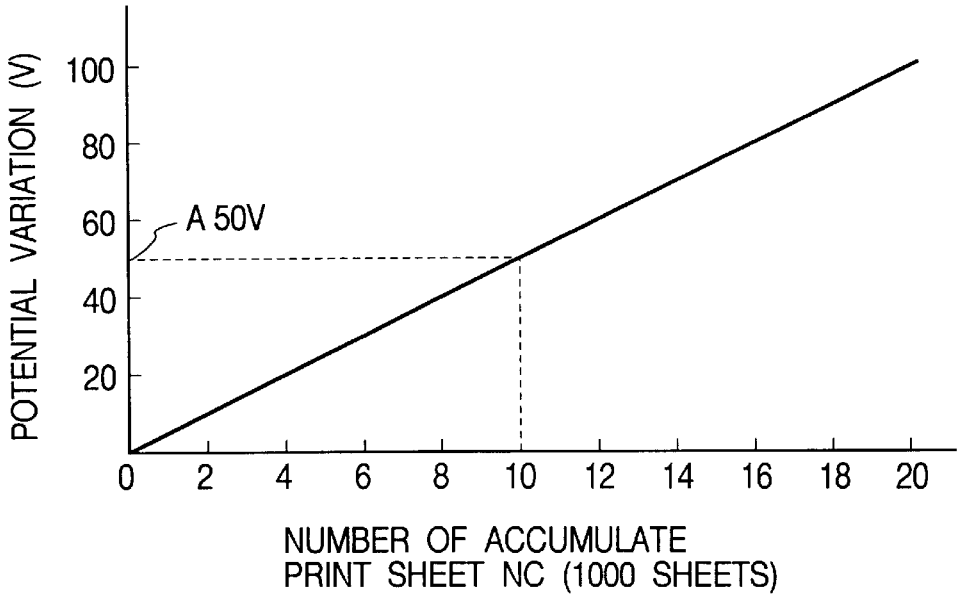
FIG. 19 is a graph showing a relation between number of accumulated print sheets and exposed portion potential.
Figure 18:
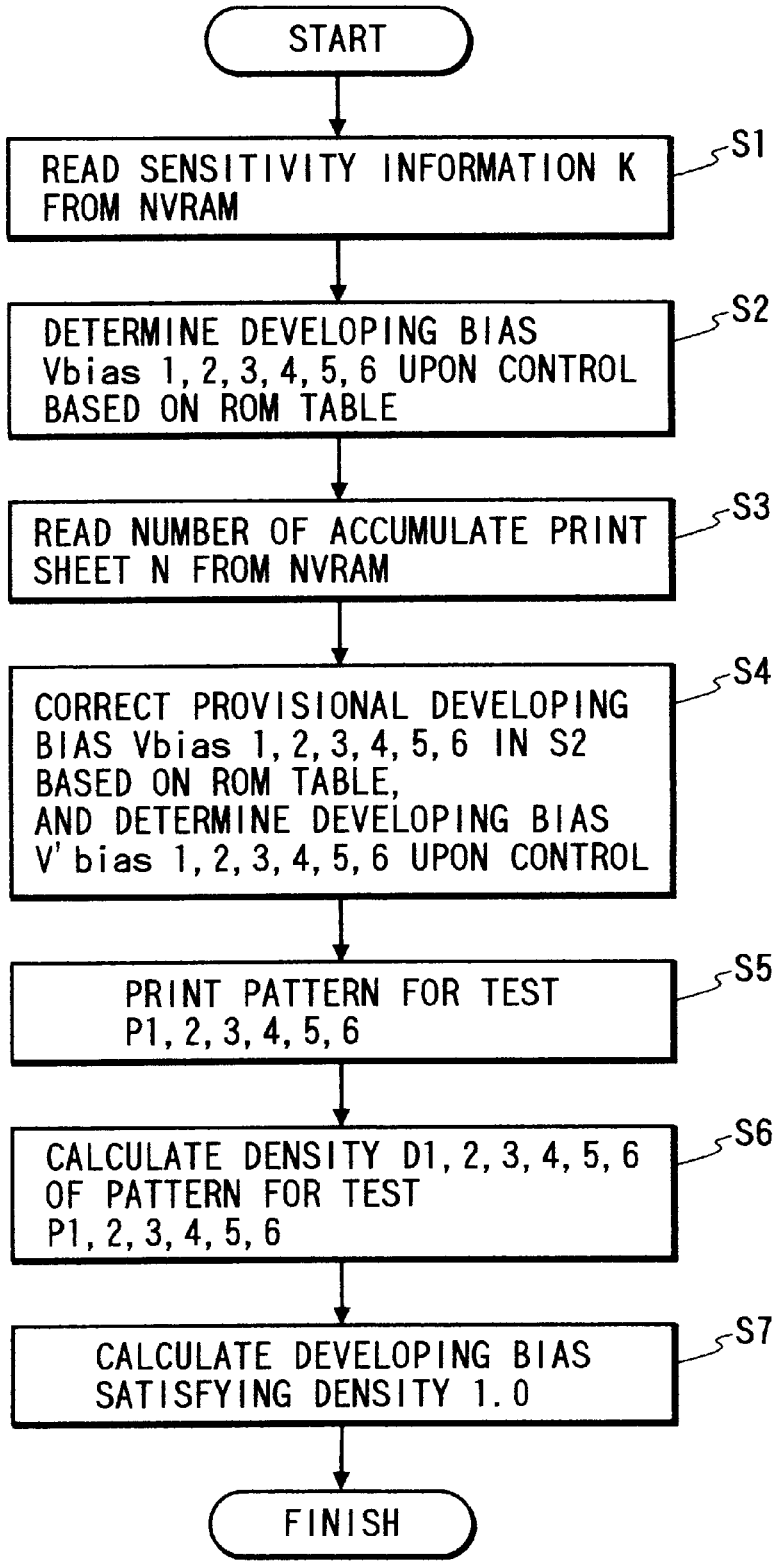
FIG. 18 is a control flow chart showing an image forming condition of the apparatus of FIG. 15.

In a step S1 in FIG. 18, as is in the aforementioned embodiment, the sensitivity information K of the photosensitive drum stored in the NVRAM 10 of the process cartridge 100 is read by the CPU 11. In a step S2, as is in the aforementioned embodiment, the CPU 11 refers to the table representing the relation between the photosensitive drum sensitivity K and the developing bias Vbias in the ROM 12, thereby temporarily determining the developing biases V1, V2, V3, V4, V5 and V6 upon the image density control. In a step S3, the CPU 11 reads the accumulated print number N stored in the NVRAM 10. In a step S4, the temporarily determined developing biases V1, V2, V3, V4, V5 and V6 determined in the step S2 is corrected while referring to the table representing the relation between the accumulated print number N and the change in exposed portion potential in the ROM 12, thereby determining the developing biases V'1, V'2, V'3, V'4, V'5 and V'6 upon actual control. Now, the relation between the accumulated print number N and the exposed portion potential will be described with reference to FIG. 19 which is a graph showing a relation between the initial exposed portion potential and the potential variation amount. As can be seen in FIG. 19, as the number of prints is increased, the sensitivity of the photosensitive drum is reduced and the exposed portion potential is increased. This relation is written as a table which is in turn stored in the ROM 12. The actual exposed portion potential is corrected in accordance with the accumulated print number N from the NVRAM 10.

More specifically, if the sensitivity K of the photosensitive drum at the manufacture thereof stored in the NVRAM 10 is 5 (K=5), the temporarily determined developing biases V1, V2, V3, V4, V5 and V6 become −250 V, −275 V, −300 V, −325 V, −350 V and −375 V, respectively. When the accumulated print number N is 10,000, as shown in FIG. 19, it is considered that the actual exposed portion potential is increased by 50 V, and, −300 V, −325 V, −350 V, −375 V, −400 V and −425 V corrected by the increased potential may be used as the developing biases V'1, V'2, V'3, V'4, V'5 and V'6 upon actual control. Further, if the sensitivity variation depending upon the print number is changed in accordance with the initial sensitivity of the photosensitive drum, the above table may be provided accordingly.

Steps S5, S6 and S7 following to the step S4 are the same as the aforementioned embodiment. Thus, the detecting patterns P1, P2, P3, P4, P5 and P6 are printed, the densities thereof are measured by the density sensor to determine the respective densities D1, D2, D3, D4, D5 and D6, and the developing biases satisfying the density 1.0 are determined on the basis of the densities D1 to D6.

As mentioned above, according to the illustrated embodiment, even when the sensitivity of the photosensitive drum is reduced in use due to the increase in the print number, since the reduction of the sensitivity is corrected on the basis of the print number, the control accuracy of the image forming condition control is improved, and, thus the image having stable density can be obtained, and the control time and toner consumption can be reduced. Even when the process cartridge is changed to the old one, the control can easily be effected.

While an example that the image forming condition is controlled by changing the developing bias was explained, the present invention is not limited to such an example, but, the charging potential or the exposure amount may be controlled.

As mentioned above, since the non-volatile memory means for storing the sensitivity information of the photosensitive drum is provided in the process cartridge including at least the photosensitive drum and the image forming condition is controlled on the basis of such sensitivity information, the image forming condition can be optimized regardless of the selection of the photosensitive drums. As a result, in the image forming condition control at the exchange of the process cartridge, the number of required detecting images can be decreased, the image density control time and consumed toner can be reduced.

In addition, when the number of the print sheets is written in the non-volatile memory means and the sensitivity of the photosensitive drum is corrected on the basis of the information regarding the number of the print sheets, even when the sensitivity of the photosensitive drum is reduced due to increase in the number of the print sheets, the control time and consumed toner can similarly be reduced regardless of the selection of the photosensitive drums. Further, in any cases, even if the control becomes impossible, since the image forming condition obtained by previously measuring the sensitivity of the photosensitive drum can be used, the change in density can be reduced.

Incidentally, the process cartridge may incorporate therein an electrophotographic photosensitive member, and a charge means, a developing means or a cleaning means as a unit which can removably be mounted to an image forming apparatus, or may incorporate therein an electrophotographic photosensitive member, and at least one of a charge means, a developing means and a cleaning means as a unit which can removably be mounted to an image forming apparatus, or may incorporate therein an electrophotographic photosensitive member, and at least a developing means as a unit which can removably be mounted to an image forming apparatus.

The present invention is not limited to the above-mentioned embodiments, various alterations and modifications can be made within the scope of the invention.

What is claimed is:

1. An image forming apparatus comprising:

a photosensitive member;

an image forming means for forming an image on said photosensitive member;

a density detecting means for detecting density of the image formed on said photosensitive member, and having a light emitting element and a light receiving element for receiving reflecting light reflected from said photosensitive member;

an image forming condition controlling means for controlling an image forming condition of said image forming means on the basis of a detected density of a test image formed on said photosensitive member;

a memory means for storing an information regarding said photosensitive member; and a light emitting amount controlling means for controlling a light emitting amount of said light emitting element on the basis of the information regarding said photosensitive member.

2. An image forming apparatus according to claim 1, wherein the information regarding said photosensitive member is information associated with light reflection factor of said photosensitive member.

3. An image forming apparatus according to claim 1, wherein the information regarding said photosensitive member is a reflection light amount when predetermined light is illuminated on said photosensitive member not yet used.

4. An image forming apparatus according to claim 1, wherein the information regarding said photosensitive member is a reflection light amount when predetermined light is illuminated on said photosensitive member at the manufacture thereof.

5. An image forming apparatus according to claim 1, wherein said photosensitive member can be exchanged together with said memory means.

6. An image forming apparatus according to claim 1, wherein said memory means comprises a non-volatile RAM.

7. An image forming apparatus according to claim 1, wherein the image forming apparatus performs the density detection of the test image after the light emitting amount of said light emitting element is adjusted in accordance with the information regarding said photosensitive member, and then the image forming condition of the image forming apparatus is adjusted.

8. An image forming apparatus according to claim 1, wherein said image forming means has a developing portion for developing a latent image formed on said photosensitive member, and said image forming condition controlling means controls bias voltage applied to said developing portion, on the basis of the detected density.

9. A process cartridge removably mountable to an image forming apparatus capable of controlling image density, comprising:

photosensitive member; and a memory means for storing information regarding said photosensitive member; wherein the information regarding said photosensitive member is information associated with light reflection factor of said photosensitive member.

10. A process cartridge removably mountable to an image forming apparatus capable of controlling image density, comprising:

photosensitive member; and a memory means for storing information regarding said photosensitive member; wherein the information regarding said photosensitive member is a reflection light amount when predetermined light is illuminated on said photosensitive member not yet used.

11. A process cartridge, removably mountable to an image forming apparatus capable of controlling image density, comprising:

photosensitive member; and a memory means for storing information regarding said photosensitive member; wherein the information regarding said photosensitive member is a reflection light amount when predetermined light is illuminated on said photosensitive member at the manufacture thereof.

12. A process cartridge according to one of claims 9–11, wherein said memory means comprises a non-volatile RAM.

13. A process cartridge according to one of claims 9–11, further comprising at least one of a charge means for charging said photosensitive member, a developing means for supplying developer to said photosensitive member, and a cleaning means for cleaning said photosensitive member.

14. An image forming apparatus comprising:

a photosensitive member;

an image forming means for forming an image on said photosensitive member;

a density detecting means for detecting density of the image formed on said photosensitive member;

a control means for controlling an image forming condition of said image forming means on the basis of detected density of a test image formed on said photosensitive member; and a memory means for storing information regarding said photosensitive member;

wherein said image forming means forms the test image on said photosensitive member on the basis of the information regarding said photosensitive member.

15. An image forming apparatus according to claim 14, wherein the information regarding said photosensitive member is information regarding sensitivity of said photosensitive member with respect to predetermined light.

16. An image forming apparatus according to claim 14, wherein said photosensitive member can be exchanged together with said memory means.

17. An image forming apparatus according to claim 14, wherein said memory means comprises a non-volatile RAM.

18. An image forming apparatus according to claim 14, wherein said image forming means has a developing portion for developing a latent image formed on said photosensitive member, and said image forming condition controlling means controls bias voltage applied to said developing portion, on the basis of the detected density.

19. An image forming apparatus according to claim 14, wherein said image forming means forms the test image on the basis of information regarding a feature of said photosensitive member and information regarding a used amount of said photosensitive member.

* * * * *

UNITED STATES PATENT AND TRADEMARK OFFICE

CERTIFICATE OF CORRECTION

PATENT NO. : 6,070,022

DATED : May 30, 2000

INVENTORS : TATSUYA KOBAYASHI, et al.

It is certified that error appears in the above-identified patent and that said Letters Patent is hereby corrected as shown below:

COLUMN 2

Line 64, "7-36230." should read --7-36230).--

COLUMN 3

Line 2, "drum" should read --drums--.

COLUMN 6

Line 4, "VPII" should read --VPH--.

COLUMN 9

Line 51, "can not" should read --cannot--.

COLUMN 12

Line 15, "and" should read --said density detecting means--;
Line 18, "said photosensitive member;" should read --a test image formed by said image forming means;--; and
Line 21, "a" should read --the--.

UNITED STATES PATENT AND TRADEMARK OFFICE

CERTIFICATE OF CORRECTION

PATENT NO. : 6,070,022

DATED : May 30, 2000

INVENTORS : TATSUYA KOBAYASHI, et al.

It is certified that error appears in the above-identified patent and that said Letters Patent is hereby corrected as shown below:

COLUMN 14

Line 32, please insert the following claims:

--20. An image forming apparatus comprising:

a photosensitive member;

an image forming means for forming an image on said photosensitive member;

a density detecting means for detecting density of the image formed on said photosensitive member;

an image forming condition controlling means for controlling an image forming condition of said image forming means on the basis of a detected density of a test image formed on said photosensitive member;

a memory means for storing an information regarding said photosensitive member; and an adjusting means for adjusting said density detecting means on the basis of the information regarding said photosensitive member.

UNITED STATES PATENT AND TRADEMARK OFFICE

CERTIFICATE OF CORRECTION

PATENT NO. : 6,070,022

DATED : May 30, 2000

INVENTORS : TATSUYA KOBAYASHI, et al.

It is certified that error appears in the above-identified patent and that said Letters Patent is hereby corrected as shown below:

COLUMN 14

21. An image forming apparatus according to Claim 20, wherein the information regarding said photosensitive member is information associated with light reflection factor of said photosensitive member.

22. An image forming apparatus according to Claim 20, wherein the information regarding said photosensitive member is a reflection light amount when predetermined light is illuminated on said photosensitive member not yet used.

23. An image forming apparatus according to Claim 20, wherein the information regarding said photosensitive member is a reflection light amount when predetermined light is illuminated on said photosensitive member at the manufacture thereof.

UNITED STATES PATENT AND TRADEMARK OFFICE

CERTIFICATE OF CORRECTION

PATENT NO. : 6,070,022

DATED : May 30, 2000

INVENTORS : TATSUYA KOBAYASHI, et al.

It is certified that error appears in the above-identified patent and that said Letters Patent is hereby corrected as shown below:

COLUMN 14

24. An image forming apparatus according to Claim 20, wherein said photosensitive member can be exchanged together with said memory means.--

Signed and Sealed this

Twenty-second Day of May, 2001

*Attest:*

Nicholas P. Godici

NICHOLAS P. GODICI

*Attesting Officer*

*Acting Director of the United States Patent and Trademark Office*